US005157233A

United States Patent [19]

Inokuma et al.

[11] Patent Number: 5,157,233

[45] Date of Patent: Oct. 20, 1992

[54] ELECTROMAGNETIC INDUCTION HEATER FOR HEATING A CONTINUOUS THIN SHEET WITHOUT UNDULATION

[75] Inventors: Masatomi Inokuma; Toshiyuki Sakemi; Morio Maeda, all of Ehime, Japan

[73] Assignee: Sumitomo Heavy Industries, Ltd., Tokyo, Japan

[21] Appl. No.: 641,772

[22] Filed: Jan. 16, 1991

[30] Foreign Application Priority Data

Jan. 17, 1990 [JP] Japan ..... 2-6243
Oct. 15, 1990 [JP] Japan ..... 2-106855[U]

[51] Int. Cl.[5] ..... H05B 6/14

[52] U.S. Cl. ..... 219/10.61 R; 219/10.71; 219/10.67; 219/10.75

[58] Field of Search ..... 219/10.75, 10.61 R, 219/10.61 A, 10.492, 10.71, 10.69, 10.79, 10.67

[56] References Cited

U.S. PATENT DOCUMENTS 2,652,478 9/1953 Howard ..... 219/10.61
2,761,941 9/1956 Ardichvili ..... 219/10.61 A
2,902,572 9/1959 Lackner et al. ..... 219/10.61
3,008,026 11/1961 Kennedy ..... 219/10.61 R
4,315,124 2/1982 Granstrom et al. ..... 219/10.71
4,472,616 9/1984 Maurice et al. ..... 219/10.61 R
4,595,813 6/1986 Chausse et al. ..... 219/10.71
4,678,883 7/1987 Saitoh ..... 219/10.61 R
4,761,527 8/1988 Mohr ..... 219/10.41

FOREIGN PATENT DOCUMENTS 0129160 5/1985 European Pat. Off. .
0206963 12/1986 European Pat. Off. .

*Primary Examiner*—Philip H. Leung
*Attorney, Agent, or Firm*—Burns, Doane, Swecker & Mathis

[57] ABSTRACT

In an electromagnetic induction heater for use in heating a strip by electromagnetic induction between a pair of magnetic-pole elements, a plurality of guide rollers are arranged between the magnetic-pole elements to guide the strip. The strip may be guided on the guide rollers in a staggered manner. Each guide roller may comprise a roll element of a ferromagnetic material. Each end surface of the magnetic-pole elements may be concave so that each end surface surrounds each guide roller with a gap left therebetween.

14 Claims, 3 Drawing Sheets

ELECTROMAGNETIC INDUCTION HEATER FOR HEATING A CONTINUOUS THIN SHEET WITHOUT UNDULATION

BACKGROUND OF THE INVENTION

This invention relates to an electromagnetic induction heater for use in heating a continuous thin sheet due to electromagnetic induction.

An electromagnetic induction heater of the type described is operable to heat by the use of electromagnetic induction a thin sheet, such as a strip, which is very thin as compared with its breadth. This electromagnetic induction heater is usually equipped with electromagnets disposed with a space left therebetween so as to induce eddy currents on the strip which is transported between the space in a predetermined direction. In order to induce eddy currents on the strip, the electromagnets are energized by an alternating current.

In the electromagnetic induction heater, it is desirable that the strip is uniformly heated while the strip is transferred within the space interposed between the electromagnetics. In addition, it is also preferable that, even if the strip is varied in breadth, uniform heating of the strip can be achieved.

To accomplish the above-described uniform heating, such a conventional heater is disclosed in U.S. Pat. No. 4,678,883, by Hajime Saitoh and Morio Maeda, assigned to Sumitomo Heavy Industries, Ltd. that is the same company as an assignee of this invention. In the conventional heater mentioned above, each of the electromagnets is constitutedby a plurality of magnetic pole-segments separately disposed in a direction transverse to the predetermined direction and common coils which wind the magnetic pole-segments. Such a heater may be called a transverse magnetic flux type of an electromagnetic induction heater. The magnetic pole-segments can be individually moved towards the strip. In addition, a shielding plate of a nonmagnetic material is disposed at each end portion of each magnetic pole-segment which is near the strip. Such a shielding plate serves to abruptly weaken a magnetic field which is generated at both breadthwise ends of the strip and which may be referred to as a fringing field.

Herein, let the strip of a ferromagnetic material be heated by the use of the conventional heater. In this event, the strip is likely to be undesirably or unevenly attracted to both the magnetic-pole segments opposed to one another. Moreover, consideration should be made about the fact that the strip of the ferromagnetic material has a Curie point and drastically changes its characteristics from one to another at the Curie point. Therefore, such a strip of a ferromagnetic material must be uniformly and accurately heated rather than the other strip.

At any rate, the conventional heater is not suitable for heating a strip of a ferromagnetic material because the strip is unevenly heated by the conventional heater. Such uneven heating brings about occurrence of a warp or undulation on the strip. In addition, when the strip is brought into contact with the magnetic-pole segments, the strip is undesirably broken off, which results in a reduction of a yield of the strip.

In order to prevent the strip from being broken off, attempts will have been made to widen a space interval of the magnetic-pole segments. However, these attempts are disadvantageous in that heat efficiency is degraded because a lot of magnetic-pole segments should be arranged over a range wider than the width of the strip.

SUMMARY OF THE INVENTION

It is an object of this invention to provide an electromagnetic induction heater, wherein it is possible to avoid occurrence of a warp or undulation on a surface of a strip, regardless of a material of the strip.

It is another object of this invention to provide an electromagnetic induction heater which is suitable for heating a strip of a ferromagnetic material.

An electromagnetic induction heater to which this invention is applicable is for use in heating a strip which is transferred in a predetermined direction. According to this invention, the electromagnetic induction heater comprises a pair of magnetic-pole elements arranged in face-to-face relation to each other with a space left between the pair of magnetic-pole elements to heat the strip during the transfer of the strip due to electromagnetic induction and at least one of guide rollers that is located within a space left between the pair of magnetic-pole elements for guiding the strip transferred in the predetermined direction.

DESCRIPTION OF THE PREFERRED EMBODIMENT

Figure 1:
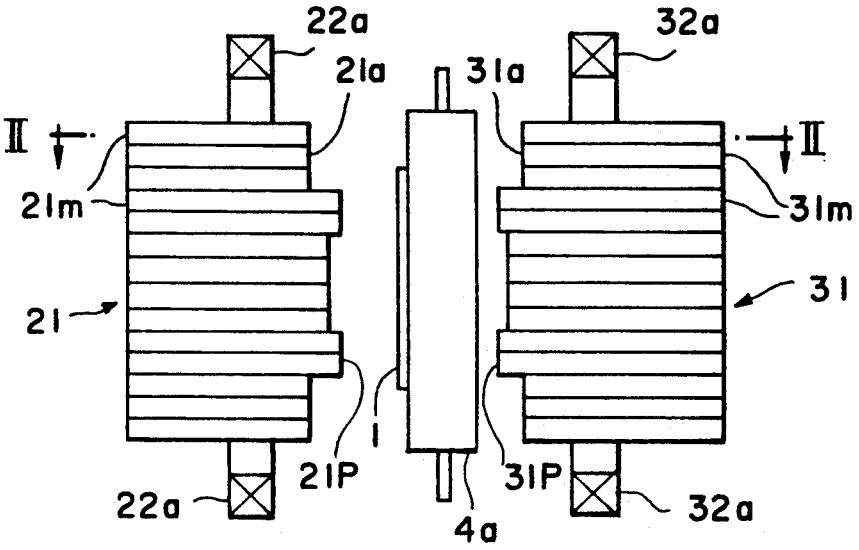
FIG. 1 is a schematic plan view of an electromagnetic induction heater according to a first embodiment of this invention.
Figure 2:
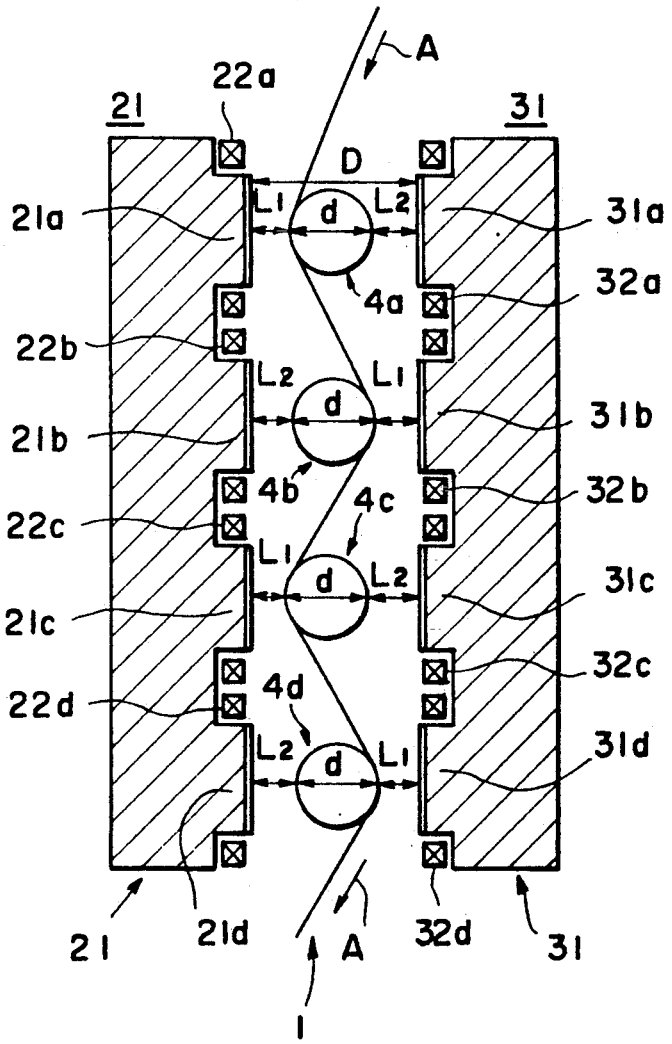
FIG. 2 is a sectional view of the electromagnetic induction heater illustrated in FIG. 1.

Referring to FIGS. 1 and 2, an electromagnetic induction heater of a transverse magnetic flux type according to a first embodiment of this invention is for use in electromagnetically heating a strip 1 which has a long length, a width, and a thin thickness and which is transported lengthwise. As a result, the illustrated strip 1 is moved in a predetermined direction directed downwards of FIG. 2. The electromagnetic induction heater comprises a pair of magnetic-pole frames 21 and 31 which is opposed to each other and disposed with a gap space left therebetween. Thus, the magnetic-pole frames 21 and 31 are in a face-to-face arrangement with each other. Each of the magnetic-pole frames 21 and 31 is composed of stacking a plurality of magnetic pole-segments 21*m* and 31*m*, as shown in FIG. 1 where m represents a natural number. The magnetic pole-segments 21*m* and 31*m* are arranged widthwise of the strip 1. In the illustrated magnetic pole-segments 21*m* and 31*m*, specific-pole segments depicted at 21*p* and 31*p* are included to adjust fringing fields on widthwise ends of the strip 1 and projected towards the strip 1 relative to the remaining magnetic pole-segments. In FIG. 2, each of the magnetic-pole frames 21 and 31 is divisible into a plurality of partial magnetic poles 21*a* to 21*d*; 31*a* to 31*d* which are partitioned by recessed portions along the predetermined direction.

Each of the partial magnetic poles 21*a* to 21*d* are directed towards the gap space and in a face-to-face arrangement with each of the partial magnetic poles 31*a* to 31*d*. Each of coil parts 22*a* to 22*d* is wound around each of the partial magnetic poles 21*a* to 21*d*.

In the illustrated example, first through fourth guide rollers 4*a* to 4*d* are arranged within the gap space between the partial magnetic poles, such as 21*a* and 31*a*, 21*b* and 31*b*, 21*c* and 31*c*, and 21*d* and 31*d*, and have the same diameter d. In FIG. 2, the guide roller 4*a* is located in the gap space with a first gap L1 spaced from the magnetic-pole frame 21 and with a second gap L2 spaced from the magnetic-pole frame 31. On the other hand, the guide roller 4*b* is spaced by the second gap L2 from the magnetic-pole frame 21 and by the first gap L1 from the magnetic-pole frame 31. Thus, the first and the second gaps L1 and L2 are changed from one to another at each guide roller, as will readily be understood from FIG. 2. As shown in FIG. 2, the strip 1 abuts on a lefthand side of the guide roller 4*a* and thereafter abuts on a righthand side of the guide roller 4*b*. Thereafter, the strip 1 alternatingly and successively abuts on a lefthand side and a righthand side of the guide rollers 4*c* and 4*d*. At any rate, the strip 1 is brought into contact with the respective guide rollers 4*a* to 4*d* in a staggered manner and is driven downwards of FIG. 2.

With this structure, it is possible to uniformly heat both surfaces of the strip 1 in a manner to be described later.

Figure 3:
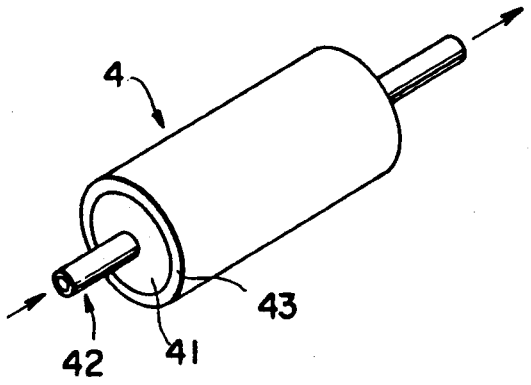
FIG. 3 is a perspective view of a guide roller used in FIGS. 1 and 2.

Referring to FIG. 3, the respective guide rollers 4*a* to 4*d* comprises a roll element 41 formed by a plurality of ferromagnetic layers, such as silicon steel, a hollow axis 42 which passes through a center portion of the roll element 41 and which is formed by a non-magnetic material, such as stainless steel, and a heat-proof coating layer 43 which is formed by a material, such as Teflon, and which is coated around the roll element 41. A width of the roll element 41 is greater than that of the strip 1. The hollow axis 42 defines a passage which serves to pass through a refrigerant on demand. The guide rollers 4*a* to 4*d* may be operable as idle rollers. Alternatively, the guide rollers 4*a* to 4*d* may comprise a rolling mechanism (not shown) which may be rotated at a rotation speed adjusted to transfer speed of the strip 1.

Now, an operation of this embodiment will be explained in detail.

The strip 1 is guided by the guide rollers 4*a* to 4*d* abutting on alternate sides of respective guide rollers 4*a* to 4*d*, as mentioned before. Thus, abutting parts are formed on the respective guide rollers 4*a* to 4*d*. Each abutting part of the guide rollers 4*a* to 4*d* is effective to prevent the strip 1 from being undulated in the width direction of the strip 1 because each abutting part is alternatingly present on the guide rollers 4*a* to 4*d*.

The strip 1 is continuously fed or transferred in a direction depicted at the arrows A, that is, lengthwise of the strip 1. During the transfer of the strip 1, the strip 1 is heated by eddy currents induced in the strip 1 by the electromagnetic induction.

Referring to FIGS. 1 through 3, a distance between the partial magnetic poles, such as 21*a* and 31*a*; 21*b* and 31*b*, is depicted at D. Each guide roller 4*a* to 4*d* includes the roller element 41 of the ferromagnetic material, as mentioned before. Accordingly, a magnetic circuit is formed between each guide roller 4*a* to 4*d* and each of the magnetic-pole frames 21 and 31 and it may be considered that the guide rollers 4*a* to 4*d* act as yokes. In this case, the distance D between the partial magnetic poles, such, as 21*a* and 31*a*; 21*b* and 21*b*, is equal to (L1+L2+d). Herein, the first gap L1 specified by a distance between each of the abutting parts of the guide rollers 4*a* to 4*d* and each partial magnetic pole 21*a*, 31*b*, 22*c*, and 32*d* while the second gap L2 is specified by a distance between each of the guide rollers 4*a* to 4*d* and the partial magnetic poles 31*a*, 21*b*, 32*c*, and 21*d*.

Accordingly, it is possible to make the first and the second gaps L1 and L2 short because the guide rollers 4*a* to 4*d* are never brought into contact with the partial magnetic poles 21*a* to 21*d*; 31*a* to 31*d*. This shows that the first and the second gaps L1 and L2 can be shortened in comparison with the D. As a result, high heat efficiency can be achieved as compared with the conventional heater. Thus, the strip 1 is continuously and uniformly heated during the transfer of the strip 1, irrespective of a material of the strip 1. Moreover, the strip 1 can uniformly be heated even when a temperature of the strip 1 exceeds the Curie point.

Figure 4:
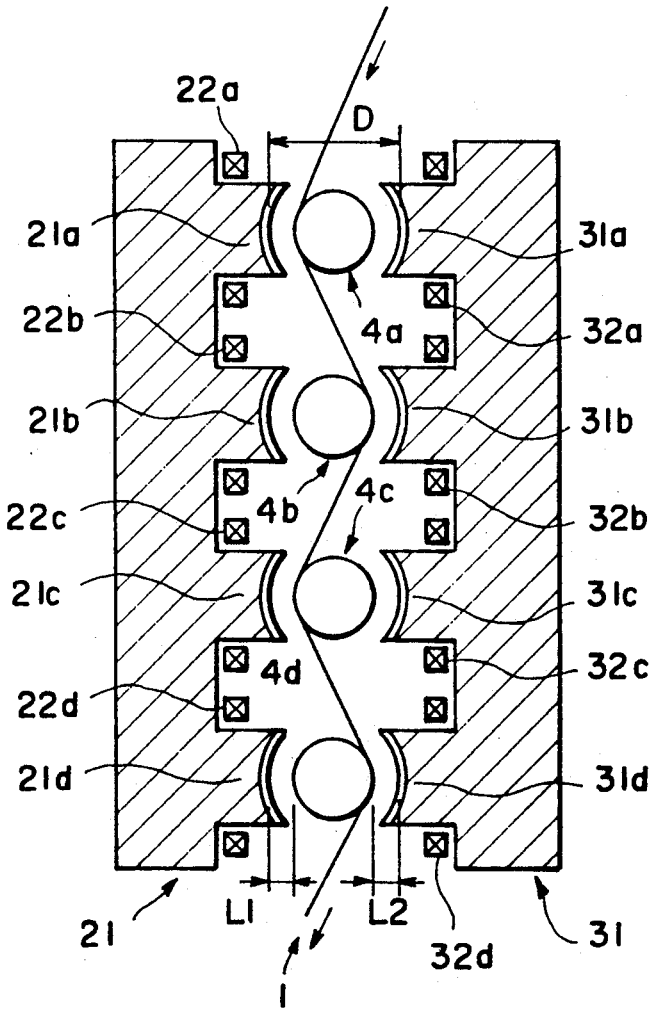
FIG. 4 is a sectional view of an electromagnetic induction heater according to a second embodiment of this invention.

Referring to FIG. 4, description will be made about an electromagnetic induction heater according to a second embodiment of this invention. The illustrated electromagnetic induction heater is similar in structure and operation to that illustrated in FIGS. 1 through 3 except that end surfaces of the partial magnetic poles 21*a* to 21*d*; 31*a* to 31*d* are directed to the strip 1.

More specifically, each of the illustrated partial magnetic poles 21*a* to 21*d* or 31*a* to 31*d* has the end face which is concave and has a predetermined curvature greater than that of the guide rollers 4*a* to 4*d*. However, each partial magnetic pole 21*a* to 21*d* or 31*a* to 31*d* may have a curvature which is substantially equal to that of the guide rollers. Thus, the partial magnetic poles 21*a* to 21*d*; 31*a* to 31*d* are effective to augment an effective field by controlling a fringing field of ends of the strip 1, namely, a circumference of the strip 1.

In order to further augment the effective field, each of the partial magnetic poles 21*a* to 21*d*; 31*a* to 31*d* comprises projection parts 21*p* and 31*p* (FIG. 1) which are effective to strengthen the magnetic field of the circumference of the strip 1.

As a result, the strip 1 is efficiently heated all over the width of the strip at every position of the partial magnetic poles 21*a* to 21*d* or 31*a* to 31*d*. In addition, it is possible to heat the strip 1 even when the strip 1 is formed by a ferromagnetic material. This is because the strip 1 is never touched to the partial magnetic poles regardless of the material. Moreover, it is possible to favorably heat the strip 1 uniformly regardless of the Curie point.

While this invention has thus far been described in conjunction with a preferred embodiment thereof, it will readily be possible for those skilled in the art to put this invention into practice in various other manners For example, as the guide rollers 4*a* to 4*d* and the partial magnetic poles 21*a* to 21*d*; 31*a* to 31*d* are never touched together, all or a part of the guide rollers 4*a* to 4*d* and projection magnetic poles 21*a* to 21*d*; 31*a* to 31*d* may be movable by a driving device so as to adjust positions thereof in the width direction of the strip.

Moreover, all of the guide rollers 4*a* to 4*d* may not always be arranged in the staggered manner as illustrated in FIGS. 1 and 4, but arranged in different manners. This shows that the invention is not restricted to the staggered arrangement.

In addition, this invention may not be restricted to the above-mentioned magnetic pole frames 21 and 31 formed by stacking many magnetic pole-segments. Specifically, each of the partial magnetic poles 21*a* to 21*d*; 31*a* to 31*d* may be individually separated from one another. A plurality of the partial magnetic poles 21*a* to 21*d*; 31*a* to 31*d* may be accommodated in a housing and be driven by the only one driving source.

As illustrated in FIGS. 1, 2, and 4, the present invention is very effective so as to prevent a strip of a ferromagnetic material from being broken off when applied to a transverse magnetic flux type of an electromagnetic induction heater.

What is claimed is:

1. An electromagnetic induction heater for use in heating a strip which is transferred in a predetermined direction, said electromagnetic induction heater comprising:

a pair of magnetic-pole elements arranged in face-to-face relation to each other with a space left between said pair of magnetic-pole elements to heat said strip during the transfer of said strip through said pair due to electromagnetic induction, and at least one guide roller located within a space left between said pair of magnetic-pole elements for guiding said strip transferred in said predetermined direction through said pair, said strip entering said space left between said pair in aid predetermined direction transverse to said pair, and said strip exiting said space left between said pair in said predetermined direction transverse to said pair, said strip being transferred without touching an element of said pair.

2. An electromagnetic induction heater as in claim 1, wherein each guide roller is formed by a ferromagnetic material.

3. An electromagnetic induction heater as in claim 1, further including means for moving at least one of said magnetic-pole elements of said pair and said at least one guide roller .

4. An electromagnetic induction heater as in claim 3, wherein said moving means changes a space gap between said at least one of said magnetic-pole elements of said pair and said at least one guide roller.

5. An electromagnetic induction heater as in claim 1, wherein each of said magnetic-pole elements has an end surface which is substantially identical in section with a roll face of said guide roller.

6. An electromagnetic induction heater as in claim 1, wherein at least one of said magnetic-pole elements has an end surface which faces at least one roll face of said guide roller and which is concave with a predetermined curvature substantially greater than a predetermined curvature of said roll face.

7. An electromagnetic induction heater as in claim 1, wherein at least one of said magnetic-pole elements has an end surface which faces at least one roll face of said guide roller and which is concave with a predetermined curvature substantially equal to a predetermined curvature of a roll face of said guide roller.

8. An electromagnetic induction heater for use in heating a strip which is transferred in a predetermined direction, said electromagnetic induction heater comprising:

first and second pole frames which are arranged with a space left therebetween along said predetermined direction and which are divided along said predetermined direction into a plurality of magnetic-pole element sets, each set comprising a pair of magnetic-pole elements arranged in face-to-face relation to each other, each of said magnetic-pole element sets disposed for heating said strip due to electromagnetic induction while said strip is being transferred between each magnetic-pole element set; and a plurality of guide rollers which are arranged in said predetermined direction so as to be interposed between the magnetic-pole sets within said space with a first gap and a second gap left between said first and said second pole frames, said strip being guided by said plurality of guide rollers so that strip is brought into alternating staggered contact with said guide rollers.

9. An electromagnetic induction heater as in claim 8, wherein said strip is ferromagnetic while each of said guide rollers comprises a roll element formed by a ferromagnetic material.

10. An electromagnetic induction heater as in claim 8, wherein said first gap and said second gap are controllable by moving said first and said second pole frames relative to said guide rollers.

11. An electromagnetic induction heater as in claim 8, further including means for moving at least one of said magnetic-pole elements of said pair and at last one guide roller, wherein said first gap and said second gap are controllable by said moving means by moving said first and said second pole frames relative to said guide rollers.

12. An electromagnetic induction heater as in claim 8, wherein each of said magnetic-pole elements has an end surface which is substantially identical in section with a roll face of said guide rollers.

13. An electromagnetic induction heater as in claim 8, wherein at least one of said magnetic-pole elements has an end surface which faces at least one roll face of said guide roller and which is concave with a predetermined curvature substantially greater than a predetermined curvature of a roll face of said guide rollers.

14. An electromagnetic induction heater as in claim 8, wherein at least one of said magnetic-pole elements has an end surface which faces at least one roll face of said guide roller and which is concave with a predetermined curvature substantially equal to a predetermined curvature of a roll face of said guide rollers.

* * * * *